United States Patent [19]

Miller

[11] 4,229,775

[45] Oct. 21, 1980

[54] CIRCUIT BREAKER MAGNETIC TRIP DEVICE WITH TIME DELAY

[75] Inventor: Robert C. Miller, Penn Hills, Pa.

[73] Assignee: Westinghouse Electric Corp., Pittsburgh, Pa.

[21] Appl. No.: 11,020

[22] Filed: Feb. 9, 1979

[51] Int. Cl.[3] ..... H01H 47/18

[52] U.S. Cl. ..... 361/210; 335/174; 335/181

[58] Field of Search ..... 335/170, 174, 180, 181, 335/182; 361/210, 93

[56] References Cited

U.S. PATENT DOCUMENTS

| | | | |
|---|---|---|---|
| 1,219,512 | 1/1919 | Hewlett | 361/210 |
| 2,552,614 | 5/1951 | Baker | 361/210 |
| 3,128,417 | 4/1964 | Brown et al. | 361/210 |
| 3,184,651 | 8/1965 | Albosta | 361/210 |
| 3,403,362 | 9/1968 | Strom | 335/174 |
| 3,534,307 | 10/1970 | Spewock et al. | 335/170 |
| 3,585,458 | 6/1971 | Yoshimura | 361/210 |
| 4,019,097 | 4/1977 | Miller et al. | 361/93 |

*Primary Examiner*—Harold Broome

*Attorney, Agent, or Firm*—Robert E. Converse, Jr.

[57] ABSTRACT

A tripping device for a circuit breaker combines the functions of a current transformer and trip actuator. The device comprises a core member, and an armature disposed in relationship to the core member to establish first and second magnetic circuits. A primary winding carrying load current of an associated circuit interrupter is coupled to the first magnetic circuit and a secondary winding is coupled to the second magnetic circuit, the secondary winding having a temperature dependent switching resistor connected across its output. The armature is movable between normal and trip positions. Low to moderate overloads cause the resistor to heat and switch to a lower resistance, thereby permitting increased current to flow in the secondary winding. This generates magnetic flux opposing the flux produced by the primary winding to lower the net flux in the second magnetic circuit. Magnetic forces on the armature thereby become unbalanced, allowing the armature to move to the trip position. The switching resistor has a switching characteristic such that an inverse time-current delayed trip operation is provided.

A spring and stop screw are provided to act upon the armature to allow the armature to immediately move to the trip position upon large overcurrent conditions, thereby providing an instantaneous trip capability.

14 Claims, 8 Drawing Figures

CIRCUIT BREAKER MAGNETIC TRIP DEVICE WITH TIME DELAY

BACKGROUND OF THE INVENTION

1. Field of the Invention

The invention relates generally to circuit breakers, and, more particularly, to circuit breakers with instantaneous and delayed trip capability.

2. Description of the Prior Art

Circuit breakers provide protection to electrical circuits and apparatus by automatically interrupting load current upon occurrence of overload conditions. Normally, circuit breakers employ an inverse time-current trip characteristic, such that extreme overloads will cause almost immediate interruption and low to moderate overloads will induce a time delay before trip to allow transient conditions to clear themselves before interruption occurs, thereby preventing unnecessary power outages.

Traditional circuit breakers employed two tripping devices to provide this inverse time-current characteristic. Instantaneous trip was produced by a magnetic device wherein load current through a conductor would produce a magnetic field during high overload conditions to attract an armature and actuate a trip mechanism. Time delay trip functions were provided by a bimetal element connected to conduct load current. Under low to moderate overloads, the bimetal would heat and deflect, the deflection being dependent upon the degree of overload and the length of time during which it occurs. When the bimetal deflected past a certain point, it released a latch or otherwise actuated the trip mechanism to produce an interruption.

More sophisticated electrical distribution protection systems require time-current tripping characteristics carefully tailored for the circuit breakers involved. This is provided in some instances using current transformers disposed around the circuit conductors to provide a current signal to an electronic circuit, the parameters of which are adjusted to provide an actuating signal to the trip mechanism according to the desired time-current tripping characteristic.

Such electronic trip circuits are very successful in many applications. However, the increased component count including a large number of electronic devices increase the probability of component failure. In addition, some electronic trip circuits require sensitive permanent magnet trip actuators which can suffer damage if the circuit breaker is subjected to rough handling prior to installation.

On some applications, the cost of providing a current transformer and an electronic tripping circuit is not warranted. It would therefore be desirable to provide a simple, low cost circuit breaker trip mechanism which will give an inverse time-current tripping characteristic with fewer components.

SUMMARY OF THE INVENTION

In accordance with a preferred embodiment of the present invention, there is provided a tripping device for a circuit interrupter which employs a core of magnetic material. An armature, also of magnetic material, is disposed in relationship to the core to complete first and second magnetic circuits through the core, the armature being movable between a normal and a tripped position. A primary winding is coupled to the core member and carries load current to an associated circuit interrupter. The load current produces magnetic flux in the first and second magnetic circuits, causing balanced magnetic forces to act on the armature and maintain the armature in the normal position during normal load current conditions.

A secondary winding is disposed about a part of the second circuit which is not in common with the first circuit. The secondary winding produces an output in response to load current in the associated circuit interrupter.

Means are provided for shunting the secondary winding upon overload current conditions. This will cause the magnetic flux in the second circuit to be altered so as to unbalance the forces applied to the armature. The armature will then move to the tripped position to actuate a mechanism in the associated circuit breaker to cause a tripping operation.

In a preferred embodiment, the shunting means comprises a switching resistor connected across the output of the secondary winding and composed of material having a characteristic such that if a voltage less than some critical voltage is applied, the current through the material is always low. If a voltage above the critical voltage is applied, the current will initially be low but, after a time delay dependent upon the magnitude of the applied voltage, the current through the resistor will switch to a higher value. Materials such as vanadium dioxide or lanthanum cobalt oxide can provide a typical resistance ratio of 100:1 or more.

DESCRIPTION OF THE PREFERRED EMBODIMENT

Figure 1:
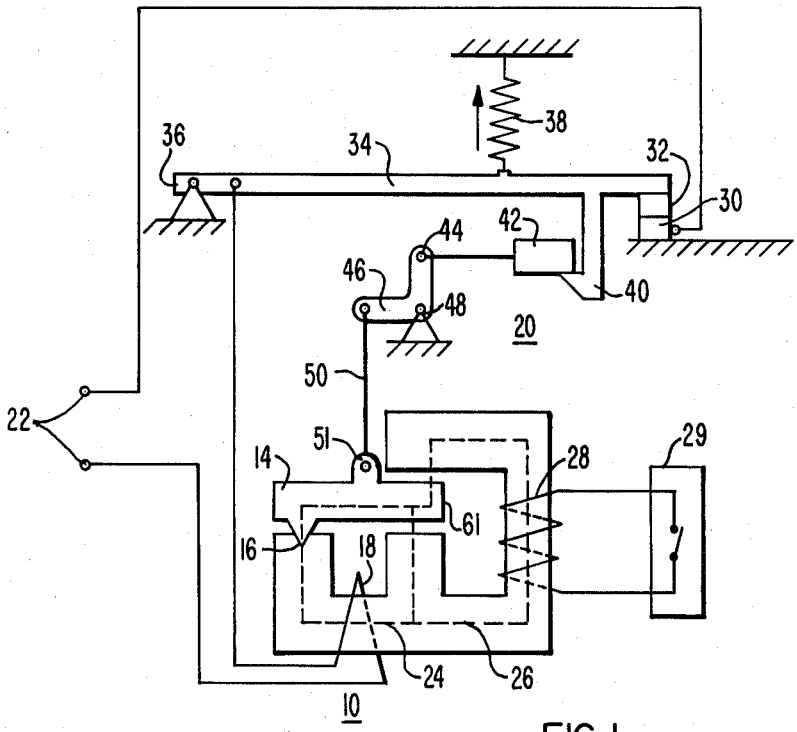
FIG. 1 is a simplified diagram, partly pictorial and partly schematic, showing the basic principle of operation of the present invention.

Referring now to the drawings, in which like reference characters refer to corresponding components, FIG. 1 shows a diagram, partially pictorial and partially schematic, of a tripping device 10 constructed according to the principles of the present invention. Tripping device 10 includes a core 12 of magnetic material. An armature 14, also of magnetic material and pivoted at the point 16, is disposed in proximity to the core 12. A primary winding 18 is wound about the core 12 and connected in series with load current through an associated circuit interrupter shown schematically at 20. The load current is supplied through terminals 22.

As can be seen in FIG. 1, load current I through the primary winding 18 will produce magnetic flux in the core 12 which will flow in two magnetic circuits 24 and 26.

A secondary winding 28 is wound about a portion of the second magnetic circuit 26 which is not common with the first magnetic circuit 24. An output from winding 28 is produced in response to the load current through the primary winding 18. Shunting means 29 are connected across the output of winding 28 in a normally-open configuration. Operation of the shunting means 29 can be responsive to the output of the secondary winding 28, or it may be independently controlled in a manner similar to a standard shunt trip operation.

The circuit interrupter 20 includes a fixed contact 30 and a movable contact 32 mounted upon a contact arm 34 which is in turn pivoted at the point 36. The arm 34 is biased upward in a counterwise opening direction by a spring 38, but is held in the contact closed position by a latch 40 held in position by a plunger 42. The plunger 42 is pivotally connected at the point 44 to a bell crank 46 pivotally mounted at the point 48. A pivoting link 50 connects the opposite end of the bell crank 46 to the armature 14 at the point 51.

During normal operation, load current through the contacts 30 and 32 and the primary winding 18 produces magnetic flux $\phi_1$ and $\phi_2$ in the magnetic circuits 24 and 26, respectively. Balanced magnetic forces are thereby produced on the armature 14 to maintain it in the position shown in FIG. 1. During overload conditions, the shunting means 29 are closed. A higher current will then flow through the secondary winding 28. This current will produce magnetic flux opposing the flux $\phi_2$, thereby greatly reducing the net flux in the magnetic circuit 26. The forces acting upon the armature 14 are thus no longer balanced and the armature 14 will pivot in a clockwise direction about the point 16 due to the larger flux $\phi_1$ in the magnetic circuit 24. This motion will be transmitted by the link 50 and the bell crank 46 to move the plunger 42 to the left as seen in FIG. 1. This releases the latch 40 allowing the contact arm 34 to pivot about the point 36 and open the contacts, thereby interrupting the load current I.

Figure 3:
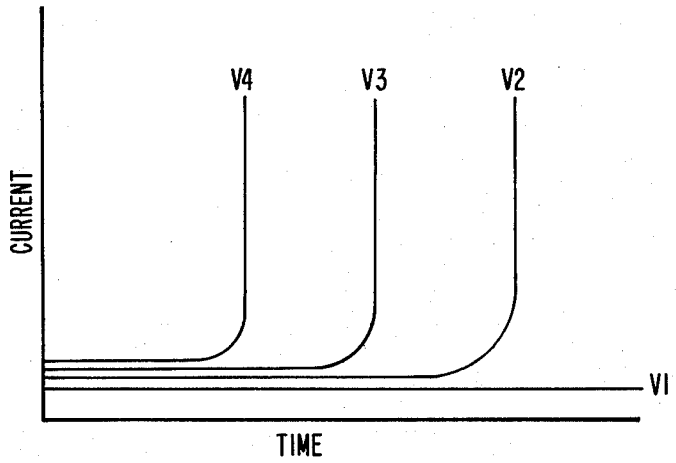
FIG. 3 is a graph showing time-current characteristics of a switching resistor employed as a shunting means.
Figure 2:
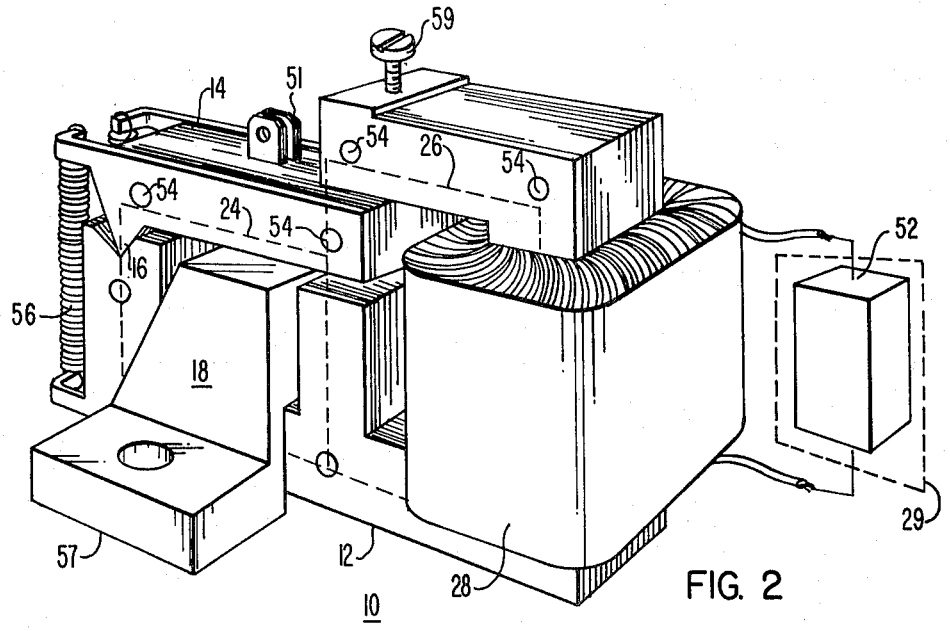
FIG. 2 is a perspective view of a preferred embodiment of the present invention.

FIG. 2 is a perspective view of an embodiment of the present invention employing a solid-state time delay switching resistor 52 connected across the output of the secondary winding 28 to serve as the shunting means 29 and to provide a time delay switching function. The resistance of the resistor 52 decreases rapidly with increasing temperature. When such a device is connected to a voltage source, a curve similar to one of the curves of FIG. 3 will result.

At a low voltage, the resistor will heat to a temperature slightly above the ambient temperature at which the rate of heat lost to the environment is just equal to the rate at which heat is generated within the resistor. The resistor will remain at this temperature indefinitely. This behavior is illustrated by the curve labeled $V_1$. At a higher applied voltage as illustrated by the curve labeled $V_2$ the resistor will start to heat as before, but will never reach a temperature at which the rate of heat lost to the environment is equal to the rate of generation within the resistor. As the temperature increases, the resistance decreases. This causes an increase in current through the resistor and a further increase in the rate of heat generation within the resistor. The increase in the rate of heat generation causes the temperature to increase more rapidly, leading to a run-away situation resulting in a rapid change in the resistance of the resistor from a high to a low value. The resistor thus effectively performs a switching function. Curves $V_3$ and $V_4$ show that switching occurs more rapidly with increasing voltage.

Switching resistors constructed of vanadium dioxide or lanthanum cobalt oxide have shown sharp switching characteristics and are thus especially suitable. The degree of time delay desired can be adjusted for circuit breakers of various ratings by modifying the size of the resistor 52 and its thermal coupling to the outside environment. Furthermore, the turns ratio of the primary and secondary coils can be adjusted to provide the desired response characteristics.

The core 12 and armature 14 of the device shown in FIG. 2 are made of a plurality of laminations of magnetic material secured by rivets 54. A spring 56 is provided on the armature to maintain the armature 14 in equilibrium position against a stop screw 59 during normal conditions. The primary winding is composed of a half turn of rigid conductor material 57 which can be bolted to the main conductor of the associated circuit breaker.

The voltage output of secondary winding 28 is subject to transient distortions produced, for example, by a metal vapor lamp or a switching thyristor connected to the load. Therefore, an integration or averaging treatment must be applied to the output signal, such as is performed by the resistor 52. This has no appreciable deleterious effect on the time delay trip function.

Instantaneous tripping is effected by the spring 56 and the adjustable stop screw 59. The spring 56 exerts an upward force on the movable end of the armature 14, while the stop screw positions the armature just below the center of the air gap 61. This unbalances the magnetic forces, providing a net downward magnetic force. Adjustment of the stop screw 59 is operative to vary the load current level at which instantaneous trip will occur.

A magnetic force is produced on the armature 14 in a clockwise direction which is proportional to the square of the load current. If a severe overcurrent equal to or greater than the instantaneous trip level of the breaker occurs, a magnetic force greater than the combined forces of the spring 56 and second circuit flux will be instantaneously exerted on the armature 14 to cause a tripping operation. The imbalance produced by the spring and stop screw has no appreciable effect on the delayed trip function.

If desired, an electronic voltage sensing and shunting circuit could be connected to the output of the secondary winding 28 in place of the resistor 52 in any of the described embodiments. Although more complex and expensive, such a circuit may be required for more sophisticated applications.

Alternatively, a simple manually operated switch could be connected to the output of the secondary winding 28, if time delay trip capability is not required and a simple shunt trip function is called for.

Figure 4:
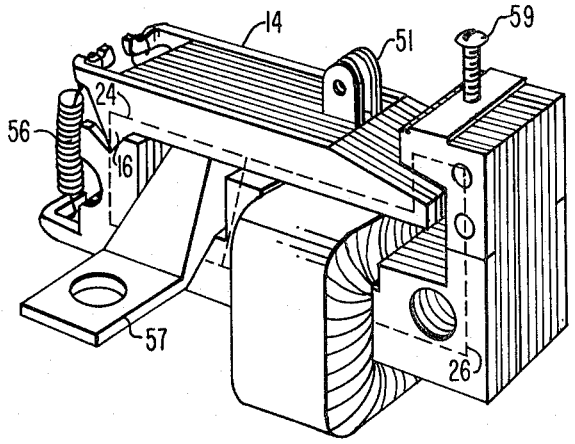
FIGS. 4 through 8 are perspective views of alternative embodiments of the present invention.

FIG. 4 shows an alternative embodiment similar to FIG. 2 with the exception that the effective length of the armature 14 for the two magnetic circuits is not equal. This may be desirable for certain applications.

Figure 5:
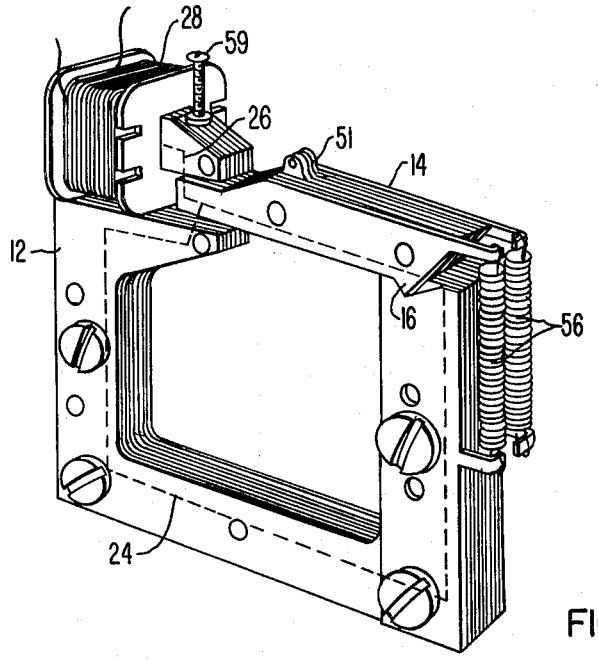

FIG. 5 shows another embodiment of the invention similar to FIG. 1 with the exception that the secondary winding 28 is placed on the core 12 without the necessity to first disassemble the core 12. The primary winding 18 is not shown in FIG. 5.

Figure 6:
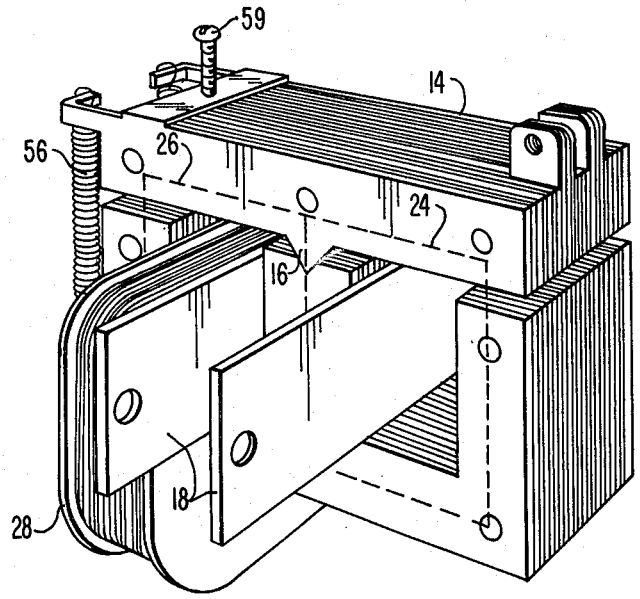

FIG. 6 shows yet another alternative embodiment employing a center pivot armature. Again, the physical layout of a specific circuit breaker may be more readily accommodated by such an alternative.

Figure 7:
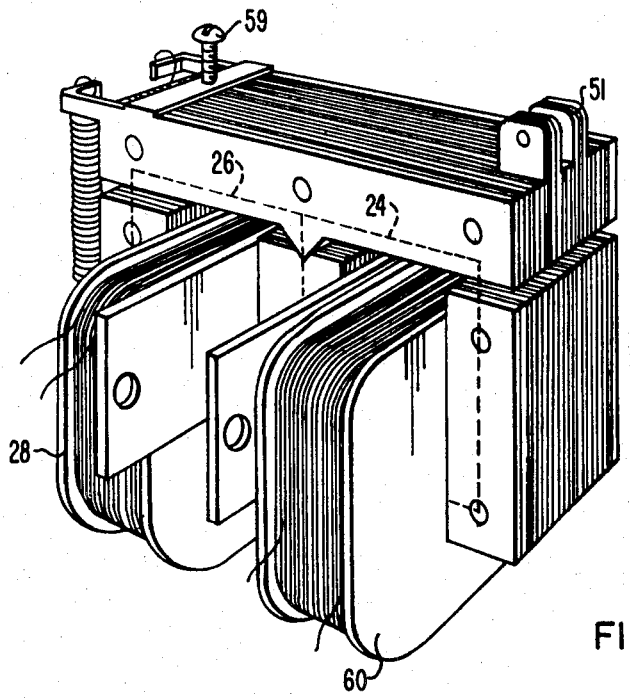

The embodiment shown in FIG. 7 is similar to FIG. 6 with the exception that an additional winding 60 has been added to the first magnetic circuit. The sum of the voltage in the windings 28 and 60 is more nearly independent of the instantaneous trip level setting than in the previously disclosed embodiments. Furthermore the tripping force provided at the pivot point 51 can be effectively increased by operating the device shown in FIG. 7 with the winding 60 shorted and the winding 28 open, and then reversing this arrangement when the unit is to be tripped. A further advantage is that the winding 60 can provide a voltage source to power an electronic timing circuit to shunt the winding 28 when required.

Figure 8:
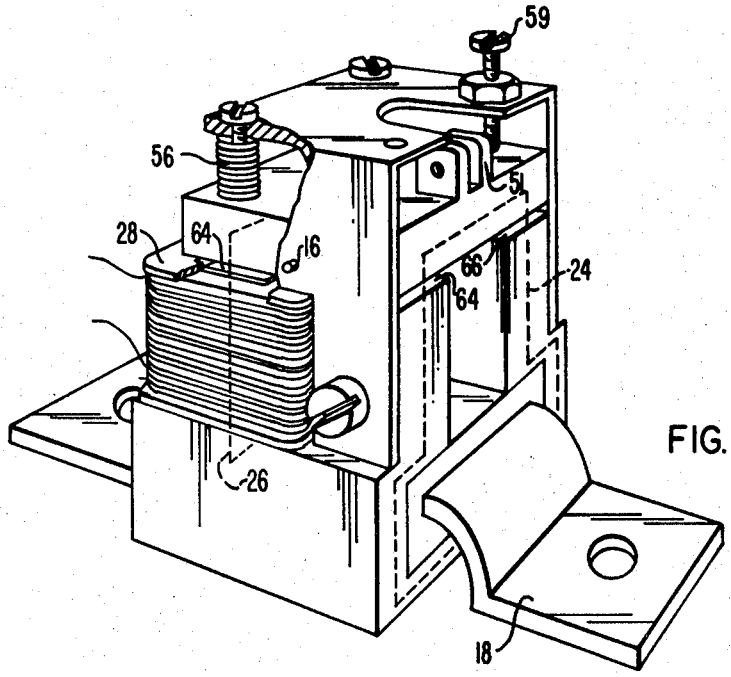

FIG. 8 shows a compact embodiment employing two air gaps 64 and 66 in each magnetic circuit. A low reluctance pivot is thus not necessary and construction of the device is somewhat simplified.

Any of the disclosed embodiments, or other embodiments, could be selected to provide a trip device for a circuit breaker according to the mechanical and electrical requirements of the specific breaker. The cost of a trip device constructed according to the present invention is low enough so as to make feasible the inclusion of a separate trip device for each phase of a multiphase circuit breaker.

It can be seen therefore that the principles of the present invention provide a magnetic trip device which combines the function of the current transformer and trip actuator of the prior art into a single device. This results in a simple reliable mechanism performing the desired function at a lower cost.

What is claimed is:

1. A tripping device for a circuit interrupter, comprising:

a core member of magnetic material;

an armature of magnetic material disposed in relationship to said core member to complete first and second magnetic circuits, said armature being movable between normal and tripped positions, movement to the tripped position being operable to trip an associated circuit interrupter;

a primary winding coupled to said core member and carrying load current to an associated circuit interrupter, whereby said load current produces magnetic flux in said first and second circuits causing magnetic forces to act on said armature and maintain said armature in the normal position during normal load current conitions;

a secondary winding disposed about a part of said second circuit not in common with said first circuit, said secondary winding producing an output proportional to said load current; and means for shunting said secondary winding upon overload current conditions, whereby the magnetic flux in said second circuit is altered so as to unbalance the forces upon said armature and cause said armature to move to the trip position.

2. A device as recited in claim 1, wherein said core member is substantially E-shaped having a base member and three perpendicular legs with one end leg longer than the other two, said core member also comprising a member inwardly extending from said longer leg and forming an air gap with the center leg, said armature being pivotted upon the end leg opposite said longer leg and extending into said air gap.

3. A device as recited in claim 2 wherein said core member comprises a plurality of laminated plates.

4. A device as recited in claim 1 wherein said core member is substantially E-shaped having a base member and three perpendicular legs, said armature being pivoted upon the center of said legs and forming an air gap with each of said end legs.

5. A device as recited in claim 1 wherein:

said core member comprises means defining a channel for receiving a conductor carrying load current to an associated circuit interrupter and two pairs of upwardly extending legs, one of said pairs at each end of said channel;

said device comprising a support structure attached to said core member and pivotally supporting said armature at a point between said pairs of legs so that said armature forms two pairs of air gaps, one pair with each of said pairs of legs, said first magnetic circuit passing substantially through said first leg pair and said first air gap pair, and said second magnetic circuit passing substantially through said second leg pair and said second air gap pair.

6. A device as recited in claim 1 comprising a third winding also coupled to said first magnetic circuit.

7. A device as recited in claim 1 comprising mechanical means biasing said armature toward the open position and means for limiting travel of said armature in the direction of said biasing means action;

said biasing means and said limiting means being so disposed with relation to said armature that during normal load current conditions to an associated circuit breaker, mechanical and magnetic forces upon said armature are balanced so as to maintain said armature in the open position, during low to moderate overcurrent conditions said armature is maintained in the open position until said shunting means is actuated to reduce the magnetic force upon said armature from said second magnetic circuit and cause said armature to move to the trip position, and upon high overcurrent conditions the magnetic force upon said armature produced by said first magnetic circuit is sufficient to move said armature to the tripped position independent of the action of said second magnetic circuit.

8. A device as recited in claim 1 wherein said shunting means is responsive to the output of said secondary winding.

9. A device as recited in claim 8 wherein said shunting means comprises a temperature dependent switching resistor.

10. A device as recited in claim 9 wherein said switching resistor consists essentially of material having a resistivity which decreases upon increasing temperature.

11. A device as recited in claim 10 wherein said switching resistor material consists essentially of vanadium dioxide.

12. A device as recited in claim 10 wherein said switching resistor consists essentially of lanthanum cobalt oxide.

13. A device as recited in claim 1 comprising an electronic timing circuit responsive to the output of said secondary winding, and said shunting means is responsive to said electronic timing circuit.

14. A device as recited in claim 1 wherein said shunting means is responsive to an external shunt trip control.

* * * * *